US008287284B1

(12) United States Patent
Nishizawa

(10) Patent No.: US 8,287,284 B1
(45) Date of Patent: Oct. 16, 2012

(54) ROTATING ELECTRIC CONNECTOR ASSEMBLY

(76) Inventor: John Nishizawa, Martinez, CA (US)

( * ) Notice: Subject to any disclaimer, the term of this patent is extended or adjusted under 35 U.S.C. 154(b) by 0 days.

(21) Appl. No.: 13/335,456

(22) Filed: Dec. 22, 2011

(51) Int. Cl.
*H01R 39/00* (2006.01)

(52) U.S. Cl. ..... 439/13

(58) Field of Classification Search ..... 439/13, 439/17, 21–22, 24–25
See application file for complete search history.

(56) References Cited

U.S. PATENT DOCUMENTS

| | | | | |
|---|---|---|---|---|
| 4,583,798 | A | 4/1986 | Blazowiich | |
| 4,753,600 | A | 6/1988 | Williams | |
| 4,894,014 | A * | 1/1990 | Palus et al. | 439/17 |
| 4,904,189 | A | 2/1990 | Hallings | |
| 4,932,882 | A | 6/1990 | Kang | |
| 5,352,122 | A | 10/1994 | Speyer et al. | |
| 5,399,093 | A | 3/1995 | Schneider et al. | |
| 5,419,707 | A * | 5/1995 | Kelley | 439/21 |
| 5,429,518 | A | 7/1995 | Chen | |
| 5,468,912 | A | 11/1995 | Zalewski | |
| 5,595,503 | A | 1/1997 | Pittman et al. | |
| 6,015,307 | A | 1/2000 | Chiu et al. | |
| 6,068,490 | A | 5/2000 | Salzberg | |
| 6,077,086 | A | 6/2000 | LaRoche | |
| 6,190,180 | B1 | 2/2001 | Purington et al. | |
| 6,638,074 | B1 | 10/2003 | Fisher | |
| 7,101,187 | B1 | 9/2006 | Deconinck et al. | |
| 7,214,102 | B2 | 5/2007 | Chong | |
| 7,462,074 | B1 | 12/2008 | Devlin et al. | |
| 7,559,790 | B2 | 7/2009 | Boeck et al. | |
| 7,740,484 | B1 * | 6/2010 | Chiang | 439/13 |
| 7,819,665 | B1 | 10/2010 | Nishizawa | |
| 7,874,378 | B2 * | 1/2011 | Chen | 173/29 |

* cited by examiner

*Primary Examiner* — Xuong Chung Trans
(74) *Attorney, Agent, or Firm* — Charles L. Thoeming

(57) ABSTRACT

An improved rotating electric connector assembly includes a rotatable housing assembly having separate rotatable electrical contacts housed within a non-conductive cylindrical housing about a longitudinal axis. Embodiments of the rotatable housing assembly provide electrical connectivity between a two prong plug or a three prong plug on one rotatable housing assembly end and a corresponding two prong receptacle or three prong receptacle on the other rotatable housing assembly end.

10 Claims, 3 Drawing Sheets

ROTATING ELECTRIC CONNECTOR ASSEMBLY

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

TECHNICAL FIELD

This invention relates to an electrical connector for use with conventional electrically powered hand tools which may be moved in a circular motion such as a counterclockwise direction during use as may be required in manufacturing or maintenance operations. The invention can be for example connected between the electrical supply cord of the hand tool and a drop cord connected to a power source to prevent the supply cord from twisting and possibly being damaged as the tool is directed continuously in circles. Embodiments can be readily adapted directly into the hand tool handle, or into the electrical wall socket for 360 degree rotational electric connectivity.

BACKGROUND OF THE INVENTION

Attempts have been made in the past to prevent electrical supply cords from twisting and being damaged by operators who must direct power hand tools in continuous circular patterns. For example, in the manufacture of round table tops, jigsaws are often employed to cut wood or ply-board and such materials may be cut with a hand-held electrical jigsaw in a continuous counterclockwise direction. After one or more tops are cut the operator must stop and untwist the electrical supply cord which may be suspended from an overhead power source. In use, after sufficient twisting has occurred, the power supply or drop cord may be damaged and has to be repaired or replaced at great expense. Continuous circular movement of power hand tools normally occurs in furniture manufacturing, cloth cutting in garment plants and in other types of manufacturing and maintenance facilities.

With the known problems associated with electrical supply cord twisting, the present invention was conceived and one of its objectives is to provide a rotatable electrical connector which is easy to install between an electrical supply cord and a power hand tool and which can be readily adapted to a variety of power hand tool uses.

It is another objective of the present invention to provide a rotatable electrical connector which is relatively simple in construction yet which will provide convenience to the user and will prevent windings in supply cords when a hand tool is operated in a circular direction.

It is still another objective of the present invention to provide a rotatable electrical connector for electrical supply cords which can be easily manufactured for various voltages and which is equipped with a ground wire.

While the apparatus has been, or will be, described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112.

Any feature or combination of features described herein are included within the scope of the present invention provided that the features included in any such combination are not mutually inconsistent as will be apparent from the context, this specification, and the knowledge of one skilled in the art. For purposes of summarizing the present invention, certain aspects, advantages and novel features of the present invention are described herein. Of course, it is to be understood that not necessarily all such aspects, advantages or features will be embodied in any particular embodiment of the present invention. Additional features, advantages, objects and aspects of the present invention are apparent in the following detailed description, accompanying drawings, and claims that follow.

DISCLOSURE OF INVENTION

An improved rotating electric connector assembly includes a rotatable housing assembly having non-conductive cylindrical housing elements, each housing element having two open ends sized to receive and connectively hold a two prong electrical receptor element in an outward end of non-conductive cylindrical housing element and a two prong electrical plug element in an outward end of non-conductive cylindrical housing element. Both the two prong electrical receptor element and the two prong electrical plug element are connectively held in the desired position within each element's respective non-conductive cylindrical housing elements and secured thereto by uniform hexagonal top threaded fasteners.

The inward facing open ends of non-conductive cylindrical housing elements are sized to receive and connectively hold an internal channel insulated sleeve. Within the internal channel insulated sleeve are at least two, isolated and rotatable longitudinal electrical contact elements.

A first isolated and rotatable longitudinal electrical contact element includes a central bearing assembly having a conductive first end and a conductive second end. The conductive first end connects to the two prong electrical receptor element by a lead. The conductive second end connects to the two prong electrical plug element by a lead.

A second isolated and rotatable longitudinal electrical contact element includes a central internal channel externally threaded cylinder having a diameter sized to be received rotatably within internal channel first insulated cover and internal channel second insulated cover residing within the central bearing assembly and internal channel rotor bearing assembly, respectively. The central internal channel externally threaded cylinder has a length sufficient to be fastened by bolt elements at both ends to leads attached to the two prong electrical plug element on one end of the entire improved rotating electric connection assembly and the two prong electrical plug element at the other end.

For a three prong electrical receptor element and a three prong electrical plug element, conductive bands on external and internal surfaces of the channel insulated sleeve permits a third isolated and rotatable longitudinal electrical contact element leads from both the three prong electrical receptor element and the three prong electrical plug element to rotatably communicate through the conductive bands via internal conductive bearings on the interior surface of the internal channel insulated sleeve.

The disclosed embodiments of the improved rotating electric connector assembly readily can be adapted to a broad range of utility including without limitation integration into hand-held electrical tools and electrical wall socket assemblies.

While the apparatus has been, or will be, described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112.

Any feature or combination of features described herein are included within the scope of the present invention provided that the features included in any such combination are not mutually inconsistent as will be apparent from the context, this specification, and the knowledge of one skilled in the art. For purposes of summarizing the present invention, certain aspects, advantages and novel features of the present invention are described herein. Of course, it is to be understood that not necessarily all such aspects, advantages or features will be embodied in any particular embodiment of the present invention. Additional features, advantages, objects and aspects of the present invention are apparent in the following detailed description, accompanying drawings, and claims that follow.

BRIEF DESCRIPTION OF DRAWINGS

The above stated features, aspects, and advantages of the improved rotating electric connection socket assembly will become better understood with regard to the following description, appended claims, and accompanying drawings as further described.

BEST MODE FOR CARRYING OUT THE INVENTION

The following discussion describes in detail various embodiments of the improved rotating electric connection assembly. This discussion should not be construed, however, as limiting the improved rotating electric connection assembly to those particular embodiments. Practitioners skilled in the art will recognize numerous other embodiments as well. For a definition of the complete scope of the improved rotating electric connection assembly, the reader is directed to the appended claims.

FIGS. 1-11 depict various embodiments of the improved rotating electric connection assembly 10 (two prong) or 12, (three prong).

Figure 1:
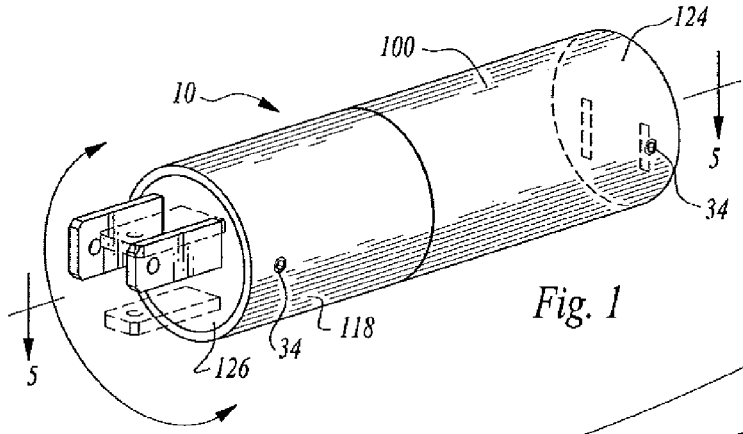
FIG. 1 is a perspective view of an embodiment of improved rotating electric connection assembly 10 ready for use by plugging the two prong electrical plug element 126 into a standard two prong electrical outlet (not shown) or the two prong electrical receptor of an electrical drop cord (not shown), and by plugging a standard two prong electrical plug or and electrical drop cord (not shown) into the two prong electrical receptor element 124, and indicating the 360 degree range of rotation of the two prong electrical plug element 126 and the two prong electrical receptor element 124 about the longitudinal axis of the assembly 10.
Figure 2:
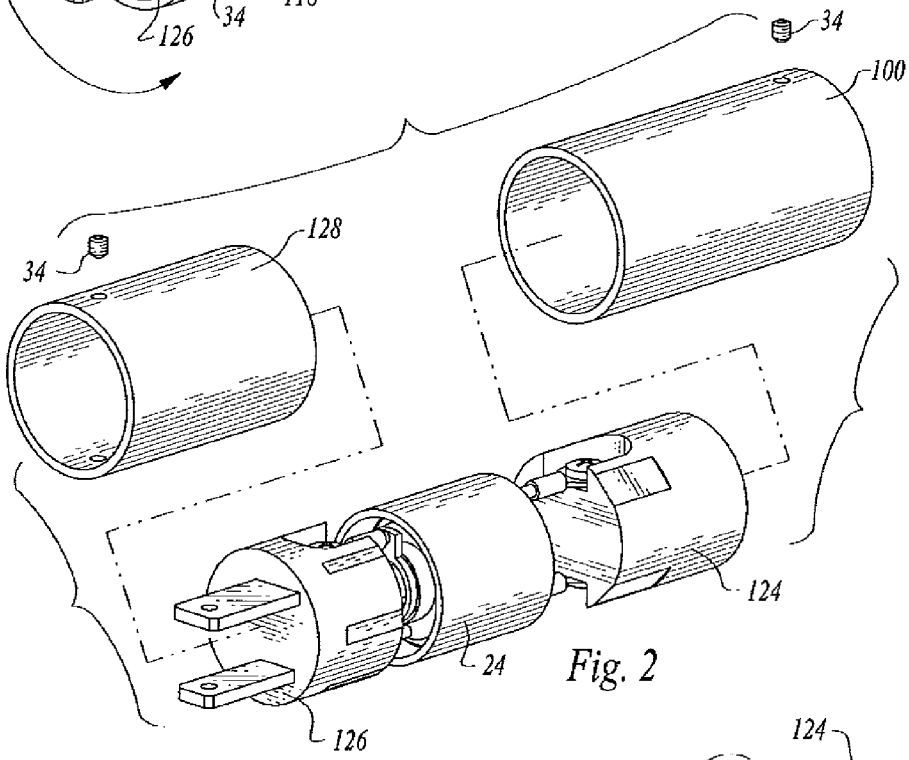
FIG. 2 is an exploded perspective view of the embodiment of rotating electric connection assembly 10 of FIG. 1, depicting the two prong electrical plug element 126, the two prong electrical receptor element 124, an internal channel insulated sleeve 24, and non-conductive cylindrical housing elements 100 and 118.
Figure 5:
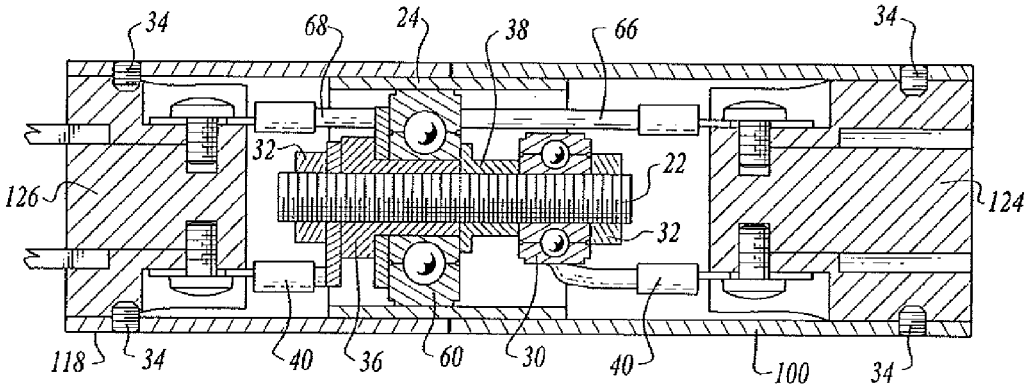
FIG. 5 is a sectional view of FIG. 1, at "5-5."

An embodiment of the improved rotating electric connection assembly 10 is shown fully assembled and ready for use in FIGS. 1 and 2, where a typical electrical cord (not shown) with a two prong plug (not shown) can be plugged into the two prong electrical receptor 124 locked into in one end of the improved rotating electric connection assembly 10, FIGS. 1, 2 and 5.

An improved rotating electric connection assembly 10 includes a rotatable housing assembly having non-conductive cylindrical housing elements 100 and 118, each housing having two open ends sized to receive and connectively hold a two prong electrical receptor element 124 in an outward end of non-conductive cylindrical housing element 100 and a two prong electrical plug element 128 in an outward end of non-conductive cylindrical housing element 118. Both the two prong electrical receptor element 124 and the two prong electrical plug element 126 are connectively held in the desired position of respective non-conductive cylindrical housing elements 100 and 118 by uniform hexagonal top threaded fasteners 34.

The inward facing open ends of non-conductive cylindrical housing elements 100 and 118 are sized to receive and connectively hold internal channel insulated sleeve 24, FIGS. 2 and 5-8. Within the internal channel insulated sleeve 24, are at least two, isolated and rotatable longitudinal electrical contact elements, FIGS. 3-5, and 7.

Figure 3:
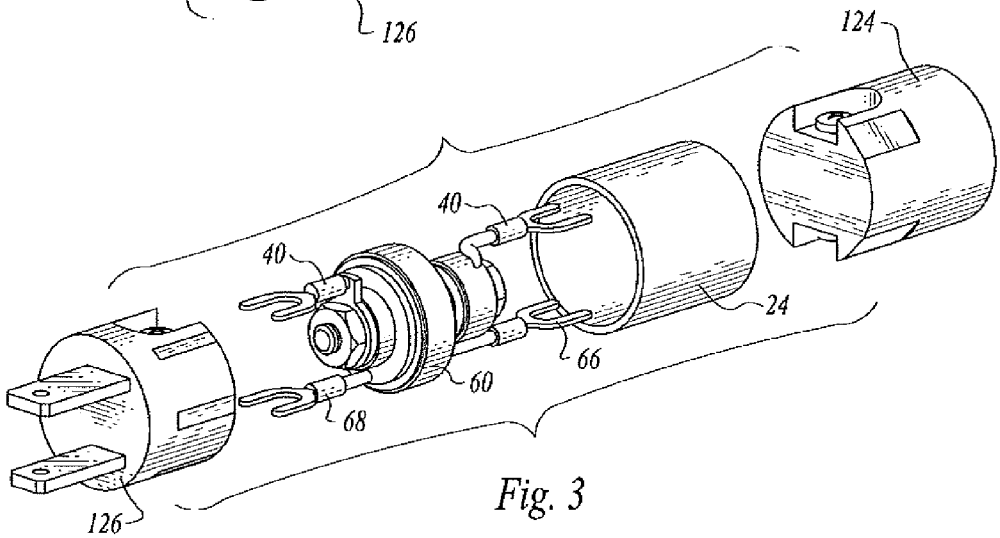
FIG. 3 is an exploded perspective view of both longitudinal 360 degree rotational electrical contact elements housed within the internal channel insulated sleeve 24 of FIG. 2 for an embodiment of the improved rotating electric connection assembly 10 of FIG. 2, depicting a central bearing assembly 60 having a first lead 66 with one end attached to a conductive first end of central bearing assembly 62 (not shown) and a second end to be attached to the two prong electrical receptor element 124, and a second lead 68 with one end attached to the conductive second end of central bearing assembly 64 (not shown) and a second end to be attached to the two prong electrical plug element 126.
Figure 4:
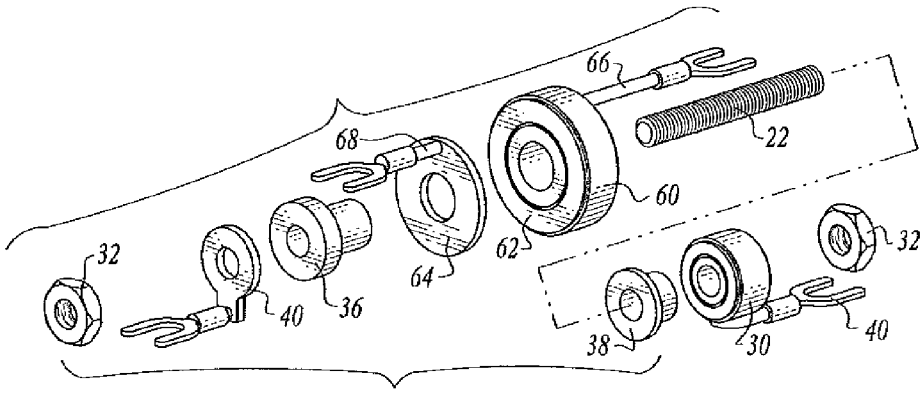
FIG. 4 is an exploded perspective view of both longitudinal 360 degree rotational electrical contact elements of an embodiment of rotating electric connection assembly 10 of FIG. 3, depicting an internal non-conductive channel insulated covers 36 and 38, dual rotor bearing assemblies within conductive housings 30 and 60, conductive end elements 62 and 64, an internal channel external threaded cylinder 22, leads 40, 66 and 68, and internal channel bolt element 32.

A first isolated and rotatable longitudinal electrical contact element includes a central bearing assembly 60 having a conductive first end 62 and a conductive second end 64, FIGS. 3-5. The conductive first end 62 connects to the two prong electrical receptor element 124 by lead 66. The conductive second end 64 connects to the two prong electrical plug element 126 by lead 68.

A second isolated and rotatable longitudinal electrical contact element includes a central internal channel externally threaded cylinder 22 having a diameter sized to be received rotatably within internal channel first insulated cover 36 and internal channel second insulated cover 38 residing within the central bearing assembly 60 and internal channel rotor bearing assembly 30, respectively. The central internal channel externally threaded cylinder 22 has a length sufficient to be fastened by bolt elements 32 at both ends to leads 40 attached to the two prong electrical plug element 126 on one end and the two prong electrical plug element 126 at the other end, FIGS. 3-5.

Figure 6:
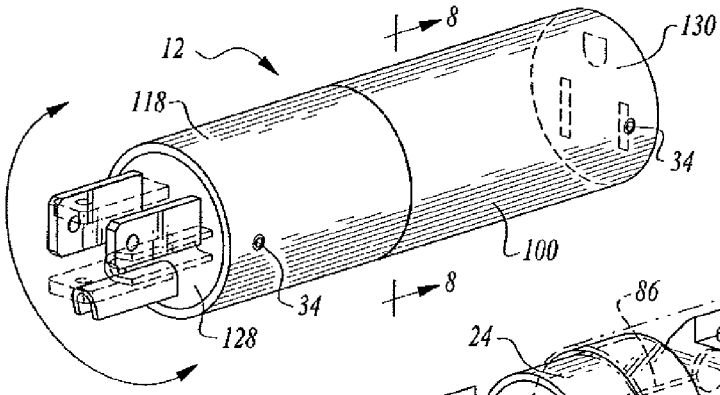
FIG. 6 is a perspective view of an embodiment of improved rotating electric connection assembly 12 ready for use by plugging the three prong electrical plug 128 into a standard three prong electrical outlet (not shown) or the three prong electrical receptor of an electrical drop cord (not shown), and by plugging a standard three prong electrical plug or and electrical drop cord (not shown) into the three prong electrical receptor 130, and indicating the 360 degree range of rotation of the three prong electrical plug 128 and the three prong electrical receptor 130 about the longitudinal axis of the assembly 12.
Figure 7:
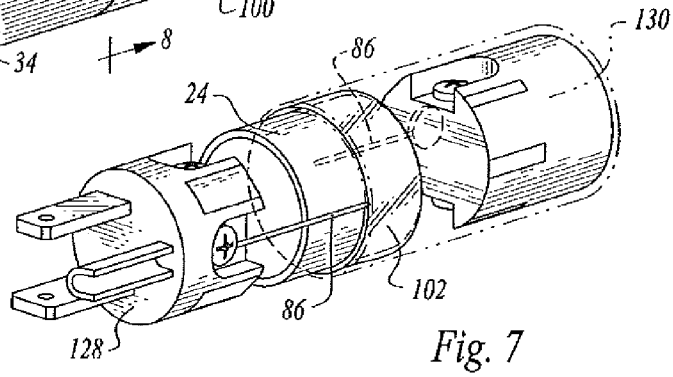
FIG. 7 is a perspective view of an embodiment of improved rotating electric connection assembly 12 of FIG. 6 with the non-conductive cylinders 100 and 118 removed to depict a third longitudinal 360 degree rotational electrical contact element including leads 86, with one lead connecting the three prong electrical plug 128 through the conductive band 102 on the outside surface of internal channel insulated sleeve 24, and the other lead connecting the three prong electrical receptor 130 through the conductive band on the inside surface of internal channel insulated sleeve 24 (not shown in this view).
Figure 8:
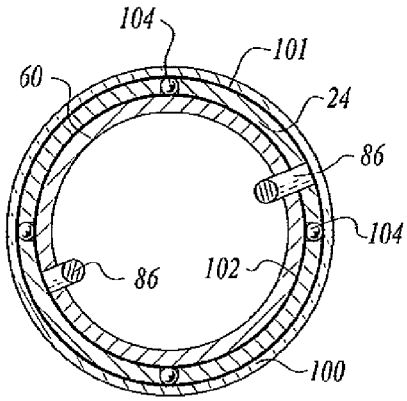
FIG. 8 is a sectional view of FIG. 6 taken at "8-8" depicting one lead 86 connecting the three prong electrical plug 128 through the conductive band 101 on the outside surface of internal channel insulated sleeve 24, the other lead 86 connecting the three prong electrical receptor 130 through the conductive band 102 on the inside surface of internal channel insulated sleeve 24, and the conductive bearings 104 connecting the conductive band 102 on the outside surface of internal channel insulated sleeve 24 and conductive band 101 on the inside surface of internal channel insulated sleeve 24.

For a three prong electrical receptor element 130 and a three prong electrical plug element 128, a conductive band 101 on an external surface of the channel insulated sleeve 24 and a conductive band 102 on an internal surface of the channel insulated sleeve 24 permit a third isolated and rotatable longitudinal electrical contact element which includes leads 86 from both the three prong electrical receptor element 130 and the three prong electrical plug element 128 to rotatably communicate through the conductive bands 101 and 102 via internal conductive bearings 104 on the interior surface of non-conductive cylindrical housing element 100, FIGS. 6-8.

FIGS. 1, 6, 9 and 10 illustrate the positions for embodiments 10 and 12 of the improved rotating electric connection assembly 10 cylindrical connector housings 100, 118, and 120 for full 360 degree rotation range along a longitudinal axis. This freedom of rotational moment allows each operable end, 124 and 126, of the improved rotating electric connection assembly 10, or 128 and 130, of the improved rotating electric connection assembly 12 to remain connectively attached to an electrical outlet or drop cord plug while being rotated in directions away from the other in a configuration dictated by the user's particular situation.

Figure 9:
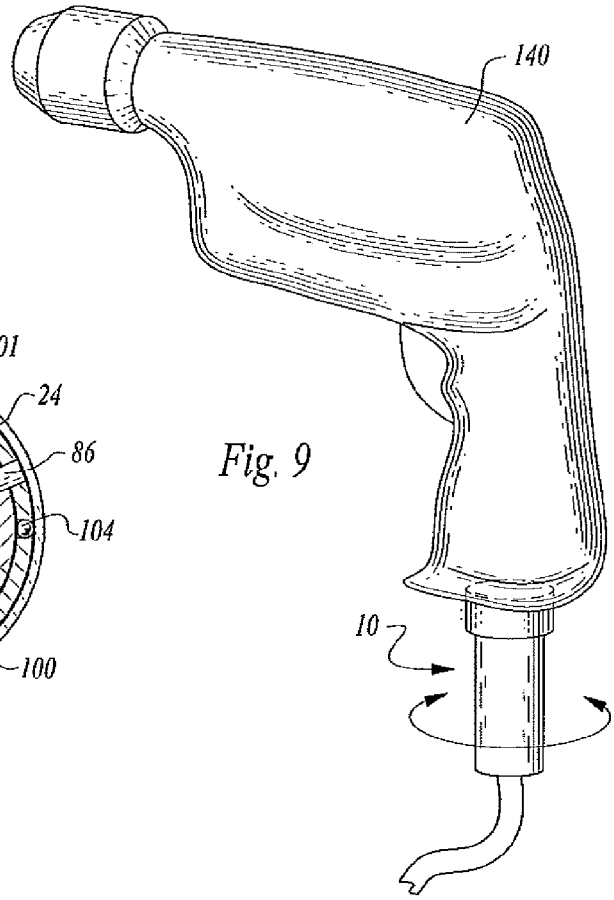
FIG. 9 is an assembled perspective view of an embodiment of improved rotating electric connection assembly 10 of FIG. 1 as part of hand tool 140 providing a 360 degree rotating electric connection assembly.

The embodiment of improved rotating electric connection assembly 10 of FIG. 1 can be adapted as a functional part of an electrically operated hand tool 140 to provide a 360 degree rotating electric connection assembly integral to the hand tool, FIG. 9.

Figure 10:
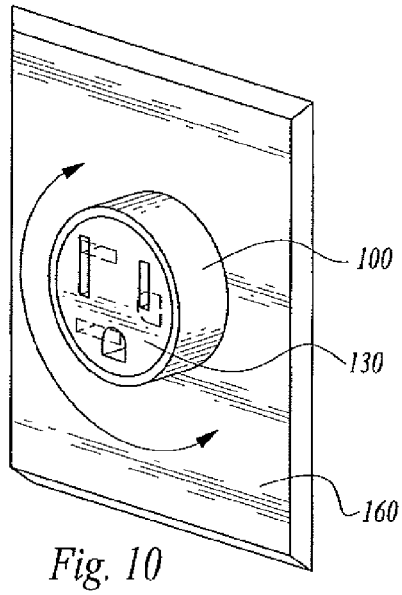
FIG. 10 is an assembled perspective view of an embodiment of improved rotating electric connection assembly 12 of FIG. 7 as part of a wall socket 160 three prong electrical receptor 130 providing a 360 degree rotating electric connection assembly.

The embodiment of improved rotating electric connection assembly 12 of FIG. 7 can be adapted as part of a wall socket 160 three prong electrical receptor 130 providing a 360 degree rotating electric connection assembly, FIG. 10.

Figure 11:
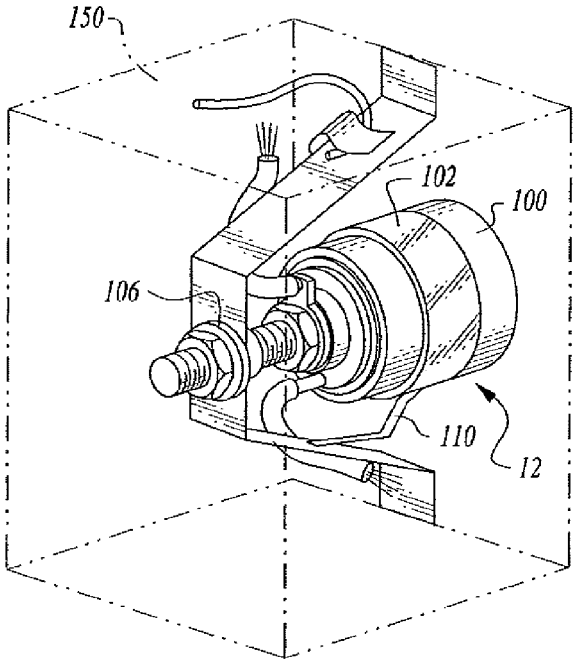
FIG. 11 is an assembled perspective view of the elements of FIG. 10 for an embodiment of improved rotating electric connection assembly 12 as part of a wall socket installation box 150 for the three prong electrical receptor 130 providing a 360 degree rotating electric connection assembly, wherein the non-conductive cylinder 118 is removed, lead 86 from the conductive band 102 on the outside surface of internal channel insulated sleeve 24 is replaced by ground contact 110, and a non-conductive washer sleeve element 116 is provided to maintain the integrity of a separate longitudinal 360 degree rotational electrical contact element.

The assembled perspective view of the elements of FIG. 10 for an embodiment of improved rotating electric connection assembly 12 as part of a wall socket installation box 150 for the three prong electrical receptor 130 providing a 360 degree rotating electric connection assembly is presented in FIG. 11. The non-conductive cylinder 118 is removed, lead 86 from the conductive band 101 on the outside surface of internal channel insulated sleeve 24 is replaced by ground contact 110, and a non-conductive washer sleeve element 116 is provided to maintain the integrity of a separate longitudinal 360 degree rotational electrical contact element, FIGS. 6-8, 11.

It will be appreciated that the examples of the embodiments 10 and 12 of the improved rotating electric connection assembly can be utilized with either (or both) the applications depicted in FIGS. 9-11, and that these applications are not limitations of the utility of embodiments 10 and 12, but instead examples of their utility.

The conductive components of the embodiments 10 and 12 of the improved rotating electric connector assembly must be chosen for their physical strength and electrical conductivity. The conductive components, such as conductive leads 40, 66, 68, and 86, central bearing 60, internal channel rotor bearing assembly 30, conductive band 102, conductive bearing 104, conductive ends 62, 64, and 54, internal channel threaded cylinder 22, and bolt elements 32, can be made from various metals typically used in electrical sockets.

Cylindrical housings 100, 118, and 24 and internal channels 36 and 38 are non-conductive portions of the body and the embodiments 10 and 12 of the improved rotating electric connector assembly, and can be made from various plastics known to be suitable in this type of application.

With respect to the above description then, it is to be realized that the optimum material and dimensional relationships for the parts of the embodiments 10 and 12 of the improved rotating electric connector assembly will include variations in size, materials, shape, and form, which will occur to those skilled in the art upon review of the present disclosure. For example the length of the cylindrical connector housings 100, 118, and 24 can be varied. Similarly, diameters of the cylindrical connector housings 100, 118, and 24 can be varied so long as the respective relationship of the longitudinal 360 degree rotational electrical connections for the contained contacts and spatial relationships among and between cylindrical housings are maintained within the housings and/or applications as disclosed.

Furthermore, the embodiments 10 and 12 of the improved rotating electric connector assembly can be adapted for use as the female end of an electrical cord or similar extension device, including both flexible and rigid extensions.

All equivalent relationships to those illustrated in the drawings and described in the specification are intended to be encompassed by the present invention.

I claim:

1. An improved rotating electric connector assembly comprising in combination:

a) first and second non-conductive housing cylindrical elements of equal diameter and length, with abutting ends aligned on a common longitudinal axis, each non-conductive housing cylindrical element comprising two ends, an internal surface, and external surface, and two threaded fastener openings from the non-conductive housing cylindrical element external surface to the non-conductive housing cylindrical element internal surface, the two threaded fastener openings paired equidistant from one non-conductive housing cylindrical element end 180 degrees from each other on the non-conductive housing cylindrical element non-abutting end;

b) an internal channel insulated sleeve sized to rotatably reside within the first and second non-conductive housing cylindrical elements, the internal channel insulated sleeve comprising a diameter sized to receive and secure two, isolated and rotatable longitudinal electrical contact elements;

c) a two prong electrical receptor element sized to be received and secured within a first non-conductive housing cylindrical element end with threaded fasteners through the two threaded fastener openings from the non-conductive housing cylindrical element external surface to the non-conductive housing cylindrical element internal surface providing access to the two prong electrical receptor element from a non-conductive housing cylinder end, and the two prong electrical receptor element is further connected by separate leads to the two, isolated and rotatable longitudinal electrical contact elements; and d) a two prong electrical plug element sized to be received and secured within a second non-conductive housing cylindrical element end with threaded fasteners through the two threaded fastener openings from the non-conductive housing cylindrical element external surface to the non-conductive housing cylindrical element internal surface providing access to the two prong electrical plug element from a non-conductive housing cylinder end, and the two prong electrical plug element is further connected by separate leads to the two, isolated and rotatable longitudinal electrical contact elements.

2. The improved rotating electric connector assembly of claim 1, wherein one isolated and rotatable longitudinal electrical contact element within the internal channel insulated sleeve comprises in combination:

a) a first central bearing assembly comprising an annular center, a first conductive end, and a second conductive end;

b) a lead from the central bearing assembly to the two prong electrical receptor element; and c) a lead from the central bearing assembly second conductive end to the two prong electrical plug element.

3. The improved rotating electric connector assembly of claim 2, wherein the other isolated and rotatable longitudinal electrical contact element within the internal channel insulated sleeve comprises in combination:

a) a first non-conductive cylinder having a central channel, sized to be received within the first central bearing assembly annular center;

b) a second central bearing assembly comprising an annular center;

c) a second non-conductive cylinder comprising a central channel, sized to be received within the second central bearing assembly annular center;

d) a conductive externally threaded rod comprising two ends and an even diameter sized to be received within the first and second non-conductive cylinder central channels such that equal threaded rod lengths extend on either side of the non-conductive cylinder, one extended rod length of the conductive externally threaded rod contacting the second central bearing assembly;

e) two internally threaded bolts sized to secure the rod on either side of the non-conductive cylinder such that equal threaded rod lengths extend beyond the bolts;

f) a lead from the second central bearing assembly to the two prong electrical receptor element; and g) a lead from the extended rod length of the conductive externally threaded rod not contacting the second central bearing assembly to the two prong electrical plug element.

4. The improved rotating electric connector assembly of claim 1 adapted to be an integral element of an electrical hand tool.

5. The improved rotating electric connector assembly of claim 1 adapted to be an integral element of an electrical wall socket.

6. The improved rotating electric connector assembly of claim 1, wherein the electrical receptor element and the electrical plug element sized to be received and secured within the non-conductive housing cylindrical element end are three prong, and wherein the internal channel insulated sleeve further comprises a third isolated and rotatable longitudinal electrical contact element comprising in combination:

a) a conductive band on an outside surface of the internal channel insulated sleeve;

b) a conductive band on an inside surface of the internal channel insulated sleeve;

c) a plurality of rotatable conductive bearings residing within the internal channel insulated sleeve such that each rotatable conductive bearing connect a portion of the conductive band on an outside surface of the internal channel insulated sleeve to the conductive band on an inside surface of the internal channel insulated sleeve;

d) a lead from the conductive band on the outside surface of the internal channel insulated sleeve the to the three prong electrical receptor element; and e) a lead from the conductive band on the outside surface of the internal channel insulated sleeve to the three prong electrical plug element.

7. The improved rotating electric connector assembly of claim 6 adapted to be an integral element of an electrical hand tool.

8. The improved rotating electric connector assembly of claim 6 adapted to be an integral element of an electrical wall socket.

9. An improved rotating electric connector assembly comprising in combination:

a) first and second non-conductive housing cylindrical elements of equal diameter and length, with abutting ends aligned on a common longitudinal axis, each non-conductive housing cylindrical element comprising two ends, an internal surface, and external surface, and two threaded fastener openings from the non-conductive housing cylindrical element external surface to the non-conductive housing cylindrical element internal surface, the two threaded fastener openings paired equidistant from one non-conductive housing cylindrical element end 180 degrees from each other on the non-conductive housing cylindrical element non-abutting end;

b) an internal channel insulated sleeve sized to rotatably reside within the first and second non-conductive housing cylindrical elements, the internal channel insulated sleeve comprising a diameter sized to receive and secure a first and a second isolated and rotatable longitudinal electrical contact element;

c) the first isolated and rotatable longitudinal electrical contact element comprising in combination:

i) a first central bearing assembly comprising an annular center, a first conductive end, and a second conductive end;

ii) a lead from the central bearing assembly to a two prong electrical receptor element; and iii) a lead from the central bearing assembly second conductive end to a two prong electrical plug element;

d) the second isolated and rotatable longitudinal electrical contact element comprising in combination:

i) a first non-conductive cylinder having a central channel, sized to be received within the first central bearing assembly annular center;

ii) a second central bearing assembly comprising an annular center;

iii) a second non-conductive cylinder comprising a central channel, sized to be received within the second central bearing assembly annular center;

iv) a conductive externally threaded rod comprising two ends and an even diameter sized to be received within the first and second non-conductive cylinder central channels such that equal threaded rod lengths extend on either side of the non-conductive cylinder, one extended rod length of the conductive externally threaded rod contacting the second central bearing assembly;

v) two internally threaded bolts sized to secure the rod on either side of the non-conductive cylinder such that equal threaded rod lengths extend beyond the bolts;

vi) a lead from the second central bearing assembly to the two prong electrical receptor element; and vii) a lead from the extended rod length of the conductive externally threaded rod not contacting the second central bearing assembly to the two prong electrical plug element;

e) the two prong electrical receptor element sized to be received and secured within a first non-conductive housing cylindrical element end with threaded fasteners through the two threaded fastener openings from the non-conductive housing cylindrical element external surface to the non-conductive housing cylindrical element internal surface providing access to the two prong electrical receptor element from a non-conductive housing cylinder end, and the two prong electrical receptor element is further connected by separate leads to the two, isolated and rotatable longitudinal electrical contact elements; and f) the two prong electrical plug element sized to be received and secured within a second non-conductive housing cylindrical element end with threaded fasteners through the two threaded fastener openings from the non-conductive housing cylindrical element external surface to the non-conductive housing cylindrical element internal surface providing access to the two prong electrical plug element from a non-conductive housing cylinder end, and the two prong electrical plug element is further connected by separate leads to the two, isolated and rotatable longitudinal electrical contact elements.

10. An improved rotating electric connector assembly comprising in combination:

a) first and second non-conductive housing cylindrical elements of equal diameter and length, with abutting ends aligned on a common longitudinal axis, each non-conductive housing cylindrical element comprising two ends, an internal surface, and external surface, and two threaded fastener openings from the non-conductive housing cylindrical element external surface to the non-conductive housing cylindrical element internal surface, the two threaded fastener openings paired equidistant from one non-conductive housing cylindrical element end 180 degrees from each other on the non-conductive housing cylindrical element non-abutting end;

b) an internal channel insulated sleeve sized to rotatably reside within the first and second non-conductive housing cylindrical elements, the internal channel insulated sleeve comprising a diameter sized to receive and secure a first, a second, and a third isolated and rotatable longitudinal electrical contact element;

c) the first isolated and rotatable longitudinal electrical contact element comprising in combination:

i) a first central bearing assembly comprising an annular center, a first conductive end, and a second conductive end;

ii) a lead from the central bearing assembly to a three prong electrical receptor element; and iii) a lead from the central bearing assembly second conductive end to a three prong electrical plug element;

d) the second isolated and rotatable longitudinal electrical contact element comprising in combination:

i) a first non-conductive cylinder having a central channel, sized to be received within the first central bearing assembly annular center;

ii) a second central bearing assembly comprising an annular center;

iii) a second non-conductive cylinder comprising a central channel, sized to be received within the second central bearing assembly annular center;

iv) a conductive externally threaded rod comprising two ends and an even diameter sized to be received within the first and second non-conductive cylinder central channels such that equal threaded rod lengths extend on either side of the non-conductive cylinder, one extended rod length of the conductive externally threaded rod contacting the second central bearing assembly;

v) two internally threaded bolts sized to secure the rod on either side of the non-conductive cylinder such that equal threaded rod lengths extend beyond the bolts;

vi) a lead from the second central bearing assembly to the three prong electrical receptor element; and vii) a lead from the extended rod length of the conductive externally threaded rod not contacting the second central bearing assembly to the three prong electrical plug element;

e) the third isolated and rotatable longitudinal electrical contact element comprising in combination:

i) a conductive band on an outside surface of the internal channel insulated sleeve;

ii) a conductive band on an inside surface of the internal channel insulated sleeve;

iii) a plurality of rotatable conductive bearings residing within the internal channel insulated sleeve such that each rotatable conductive bearing connects a portion of the conductive band on an outside surface of the internal channel insulated sleeve to the conductive band on an inside surface of the internal channel insulated sleeve;

iv) a lead from the conductive band on the outside surface of the internal channel insulated sleeve the to the three prong electrical receptor element; and v) a lead from the conductive band on the outside surface of the internal channel insulated sleeve to the three prong electrical plug element;

f) the three prong electrical receptor element sized to be received and secured within a first non-conductive housing cylindrical element end with threaded fasteners through the two threaded fastener openings from the non-conductive housing cylindrical element external surface to the non-conductive housing cylindrical element internal surface providing access to the two prong electrical receptor element from a non-conductive housing cylinder end, and the two prong electrical receptor element is further connected by separate leads to the two, isolated and rotatable longitudinal electrical contact elements; and g) the three prong electrical plug element sized to be received and secured within a second non-conductive housing cylindrical element end with threaded fasteners through the two threaded fastener openings from the non-conductive housing cylindrical element external surface to the non-conductive housing cylindrical element internal surface providing access to the two prong electrical plug element from a non-conductive housing cylinder end, and the two prong electrical plug element is further connected by separate leads to the two, isolated and rotatable longitudinal electrical contact elements.

* * * * *